US005353628A

United States Patent [19]

Bellows

[11] Patent Number: 5,353,628

[45] Date of Patent: Oct. 11, 1994

[54] STEAM PURITY MONITOR

[75] Inventor: James C. Bellows, Maitland, Fla.

[73] Assignee: Westinghouse Electric Corporation, Pittsburgh, Pa.

[21] Appl. No.: 736,363

[22] Filed: Jul. 26, 1991

[51] Int. Cl.[5] ..... F01K 13/00; G01N 27/04

[52] U.S. Cl. ..... 73/25.01; 73/31.05; 324/439; 60/657

[58] Field of Search ..... 324/696, 694, 439, 441; 415/118, 121.3; 416/61; 60/646, 657, 660; 73/23.2, 25.01, 31.03, 25.05, 61.46, 61.47, 61.44, 61.43, 61.76, 61.78, 61.41

[56] References Cited

U.S. PATENT DOCUMENTS

| | | | |
|---|---|---|---|
| 2,595,490 | 5/1952 | Schubring et al. | 60/657 |
| 3,955,403 | 5/1976 | Bodmer | 73/61.41 |
| 4,386,498 | 6/1984 | Lee et al. . | |
| 4,455,530 | 6/1984 | Lee et al. . | |
| 4,679,399 | 7/1987 | Strickler | 60/657 |
| 4,739,492 | 4/1988 | Cochran | 324/445 |
| 4,853,638 | 8/1989 | Endou et al. | 324/444 |
| 4,883,566 | 11/1989 | Muccitelli et al. | 324/439 |

*Primary Examiner*—Hezron E. Williams
*Assistant Examiner*—Michael Brock
*Attorney, Agent, or Firm*—G. R. Jarosik

[57] ABSTRACT

A steam purity monitor (10) detects the presence of sodium hydroxide and sodium chloride in a steam turbine (12). In the steam purity monitor (10), a control unit (18) is connected to a sensor unit (14) in the steam turbine (12) which has a conductance sensor (30), pressure sensor (34) and temperature sensor (32) to measure conductance, pressure and temperature in the steam turbine (12). A heating coil (40) is further provided to vary the temperature of the sensor unit (14). If conductance is detected by the conductance sensor (30), then the temperature is obtained from the temperature sensor (32) and compared by the control unit (18) to a saturation temperature calculated based on pressure readings from the pressure (34). If the temperature exceeds the saturation temperature by a predetermined amount, the control unit (18) indicates the presence of sodium hydroxide on a display unit (29). However, if the temperature does not exceed the saturation temperature by the predetermined amount, then either sodium hydroxide or sodium chloride could be present. In this case, the steam purity monitor (10) is heated by the heating coil (40) to a predetermined superheat level at which only sodium hydroxide would exist in a liquid solution. After heating, if conductance is no longer detected by the conductance sensor (30), sodium chloride is indicated. If conductance continues to be detected after heating, then sodium hydroxide is indicated.

20 Claims, 5 Drawing Sheets

STEAM PURITY MONITOR

BACKGROUND OF THE INVENTION

1. Field of the Invention

The present invention is directed to a steam purity monitor which detects the presence of sodium hydroxide and sodium chloride in a steam turbine and, more particularly, to a device which monitors conductivity, temperature, and pressure in a steam turbine and uses a computer to indicate the presence of sodium hydroxide or sodium chloride based on the conductivity, temperature and pressure in the steam turbine.

2. Description of the Related Art

In a steam turbine, it is essential for the steam therein to remain free of chemical contaminants which cause corrosion. Sodium hydroxide and sodium chloride are two such contaminants which can cause serious damage. The presence of these substances in a steam turbine, even in very small amounts, can result in corrosion and related effects, including pitting corrosion, corrosion fatigue and stress corrosion. Particularly, sodium chloride affects the blades in the turbine and sodium hydroxide affects the rotor body of the turbine, which is made from a different alloy.

Conventionally, potential contaminants are monitored by sampling the feedwater and steam of the power cycle. When the monitors suggest that sodium chloride or sodium hydroxide is in the steam delivered to the turbine, the choice is to shut the turbine down, improve the purification of the feedwater used to make the steam, or to risk corrosion damage to the turbine. Current monitors are not accurate enough to reliably indicate whether corrosive solutions are forming on the turbine. Therefore, there is considerable likelihood that a turbine will be operated with corrosive solutions present on it or that a turbine will be shut down when no corrosive solutions are actually present on it. Either of these errors is costly. The first represents corrosion damage to equipment with possible safety hazards. The second represents unnecessary economic penalty of lost generation. For these reasons, it is highly desirably to detect the presence of sodium hydroxide with certainty and differentiate it from sodium chloride. With this information, the operator can decide whether to continue to operate the turbine or to shut it down.

In addition, corrosion damage from sodium hydroxide is faster and more widespread in the turbine than corrosion damage from salts. If sodium hydroxide is present in the steam going to the turbine, acid could be added to neutralize it. Conventional monitors are inadequately reliable to determine how much acid to add. For this reason it is desirable to detect the neutralization of sodium hydroxide present in the turbine.

Although previous attempts have been made to detect contaminants in a general sense, no previous device or method is known by which sodium hydroxide is specifically detected quickly and accurately. A method for preventing corrosion in a steam turbine is disclosed in U.S. Pat. No. 4,386,498, but this method is primarily directed to detection of conductivity in the turbine to generally indicate the presence of contaminants such as sodium chloride. The method is incapable of individually differentiating between different contaminants such as sodium hydroxide and sodium chloride. Such a differentiation is very important because only the detection of sodium hydroxide merits the extreme measure of adding acid to the turbine or taking the turbine off line and opening to clean it.

SUMMARY OF THE INVENTION

An object of the present invention is to provide a steam purity monitor which detects the presence of sodium hydroxide in a steam turbine.

Another object of the present invention is to provide a steam purity monitor which detects the presence of sodium chloride in a steam turbine.

A further object of the present invention is to provide a steam purity monitor which detects sodium hydroxide and sodium chloride by detecting conductivity conditions under which sodium hydroxide and sodium chloride exist.

Yet another object of the present invention is to provide a steam purity monitor which differentiates between sodium hydroxide and sodium chloride by detecting temperature and pressure conditions under which conductivity indicates that only sodium hydroxide or sodium chloride exists.

A still further object of the present invention is to provide a steam purity monitor which differentiates between sodium hydroxide and sodium chloride by varying the temperature conditions under which conductivity and the pressure conditions indicate that either sodium hydroxide or sodium chloride exists.

Yet another object of the present invention is to provide a steam purity monitor which initiates an alarm to indicate the actual or potential presence of sodium hydroxide in a steam turbine.

A still further object of the present invention is to provide a steam purity monitor which detects when the addition of acid has effectively removed the presence of sodium hydroxide.

The present invention attains the above objects by providing a steam purity monitor which has a sensor unit that detects the presence of sodium hydroxide and sodium chloride in a steam turbine. A control unit which can be implemented, for example, with software in a computer or with a hardware circuit, is connected to the sensor unit. The sensor unit has a conductance sensor, pressure sensor and temperature sensor in the turbine to measure conductance, pressure and temperature. A heater is further provided to vary the temperature of the sensor unit.

If conductance is detected by the conductance sensor, then the temperature is obtained from the temperature sensor and compared by the control unit to a saturation temperature calculated based on pressure readings from the pressure sensor. If the temperature reaches a predetermined superheat level, that is, if the temperature exceeds the saturation temperature by a predetermined amount, the presence of sodium hydroxide is indicated by the control unit. However, if the temperature is beneath the predetermined superheat level, either sodium hydroxide or sodium chloride could be present. In this case, the steam purity probe is heated by the heater to the predetermined superheat level at which only sodium hydroxide would exist as a liquid.

After heating, if conductance is no longer detected by the conductance probe, sodium chloride is indicated. On the other hand, if conductance continues to be detected upon heating the steam purity monitor to the superheat level, sodium hydroxide is indicated. As a result, appropriate measures can be taken to remove the corrosive chemical from the turbine.

These objects together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2A is a top view and FIG. 2B is a cross-sectional side view;

DESCRIPTION OF THE PREFERRED EMBODIMENTS

Figure 1:
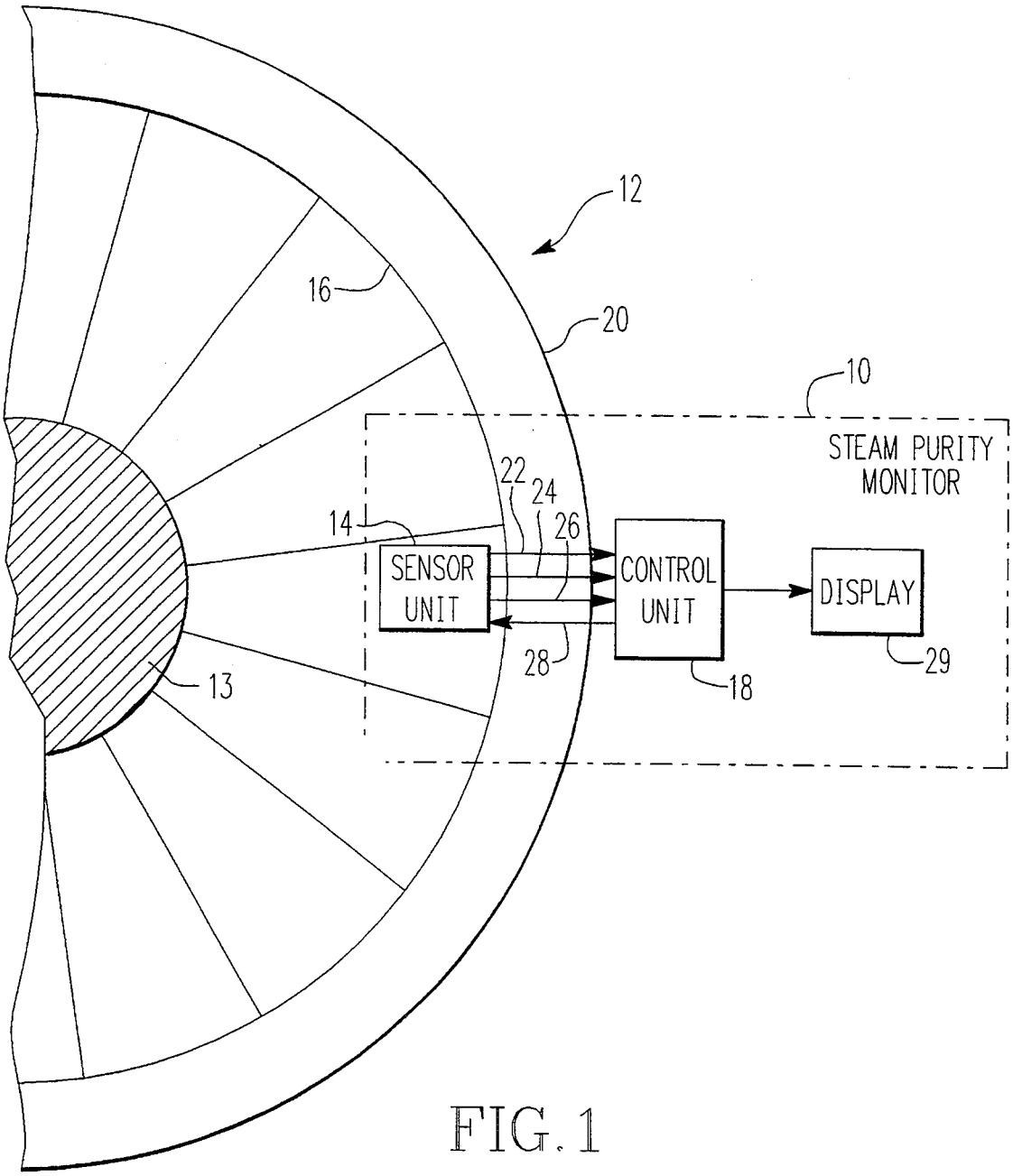
FIG. 1 is a block diagram of a first embodiment of the present invention attached to a steam turbine.

FIG. 1 illustrates application of the present invention to a steam turbine. FIG. 1 shows the steam purity monitor 10 in the steam turbine 12. The steam turbine 12 rotates about a shaft 13. The steam purity monitor 10 has a probe, or, sensor unit 14. Placement of the sensor unit 14 should be at approximately the outer edge of the steam path through the steam turbine 12. The sensor unit 14 (probe) should be located at a turbine stage where there is 50° F. (28° C.) superheat (a temperature 50° F. (28° C.) above the saturation temperature of the steam based on the existing pressure) at full turbine load. This location will vary with individual turbine design details and inlet steam pressure and temperature, but is easily calculated by an engineer familiar with turbine thermodynamics. At this location any sodium hydroxide will be in the form of a liquid solution, and any sodium chloride present will be solid.

The sensor unit 14 (probe) is mounted in proximity to the blades 15 on the inner casing 16 of the steam turbine 12. The sensor unit 14 measures conductance, temperature and pressure in the steam turbine 12, and may be heated to vary the superheat level at which the turbine is monitored. The sensor unit 14 is connected to a control unit 18 which is mounted on the outer casing 20 of the steam turbine 12. The control unit 18 receives a conductance signal along the conductance line 22, a temperature signal along the temperature line 24 and a pressure signal along the pressure line 26 from the sensor unit 14, and determines the presence of sodium hydroxide or sodium chloride on the basis of the conductivity, temperature and pressure in the steam turbine 12 as described below. If necessary, the control unit 18 varies the temperature by causing the sensor unit 14 to be heated in response to a signal along heater line 28, in order to obtain a superheat condition under which differentiation between sodium hydroxide and sodium chloride is possible. The monitoring of these conditions may be performed continually. The results are output to a display 29 indicating sodium hydroxide or sodium chloride so that a determination can be made about whether measures are necessary to remove corrosion from the turbine.

Figure 2A:
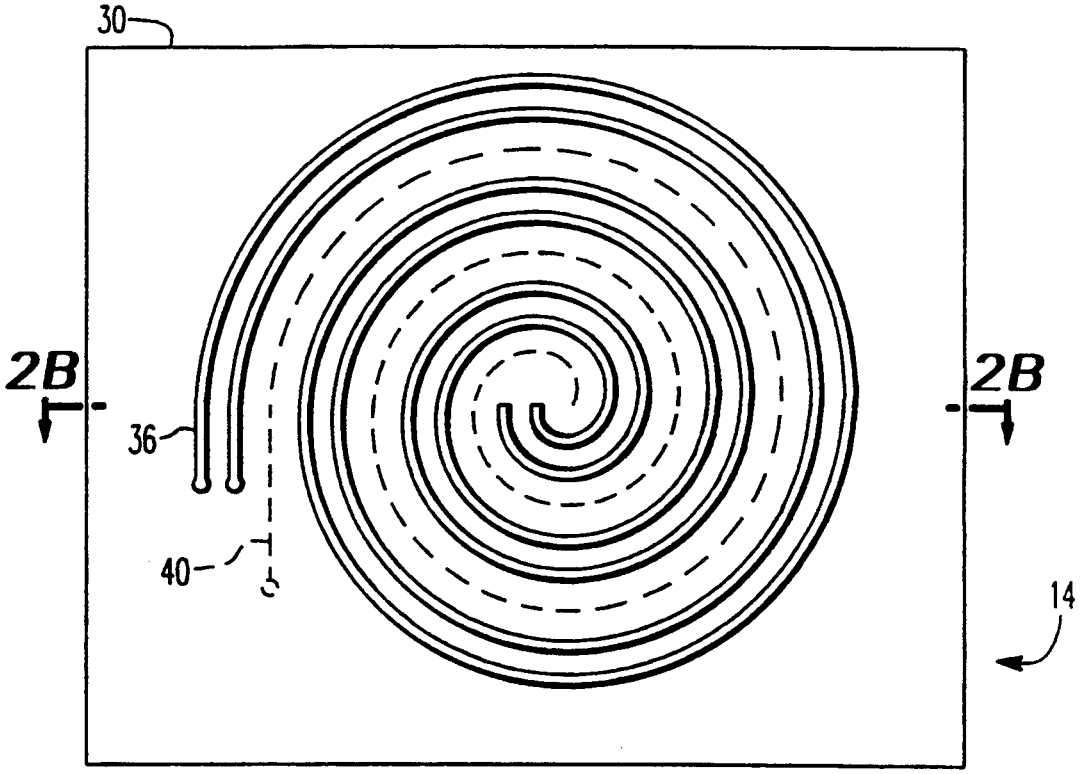
FIGS. 2A and 2B illustrate the sensor unit of the steam purity monitor, showing the probes and heater, where
Figure 2B:
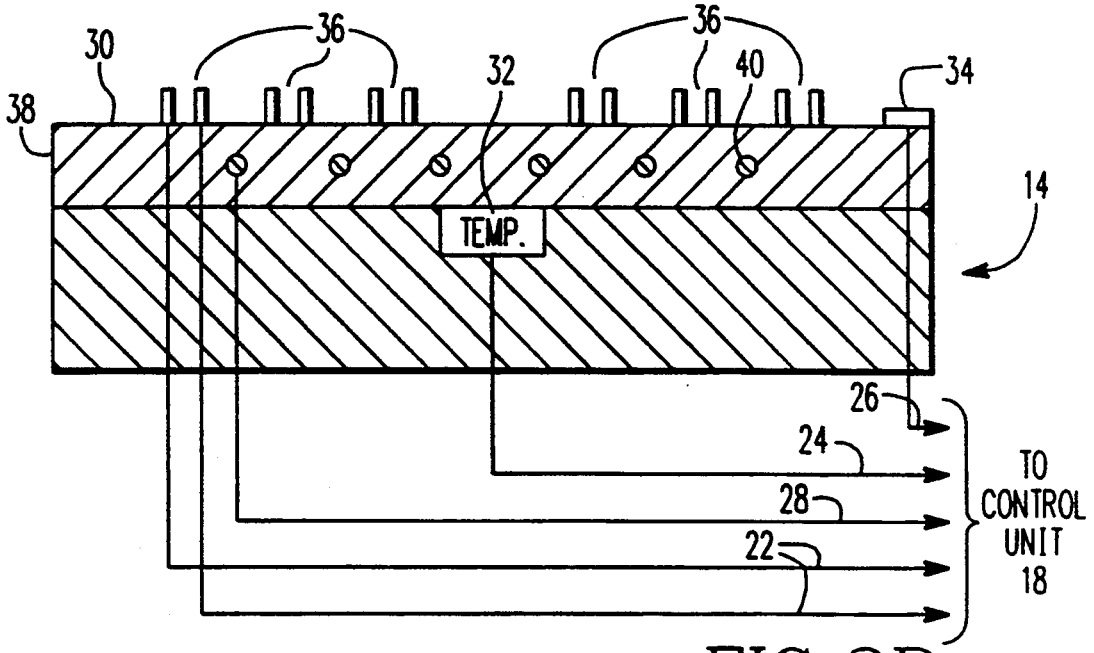

The sensor unit 14 may be constructed using conventional monitors such as a conductivity meter, a temperature monitor and a pressure monitor. FIG. 2 shows an embodiment of the sensor unit 14. FIG. 2A is a top view and FIG. 2B is a cross sectional view of the sensor unit 14 in the steam purity monitor 10. Included in the sensor unit 14 are a conductance sensor 30, described below, and conventional temperature 32 and pressure 34 sensors. The conductivity sensor on which the conductance sensor 30 is based is disclosed in U.S. Pat. No. 4,455,530 to Lee et al. incorporated herein by reference. This conductance sensor 30 has conductance leads 36 mounted on a substrate 38 made of a material capable of being heated to a high temperature, such as a ceramic. The conductance leads 36 are connected to the control unit 18 by the conductivity line 22 to deliver a conductance signal thereon.

The temperature sensor 32 and pressure sensor 34 are conventional sensors mounted on opposite sides of the substrate 38. The temperature sensor 32 is mounted beneath the substrate 38 and delivers a temperature signal to the control unit 18 along the temperature line 24. The pressure sensor 34 is mounted above the substrate 38 and delivers a pressure signal along the pressure line 26 to the control unit 18. The conductance sensor 30, temperature sensor 32 and pressure sensor 34 are all integrally mounted to provide proximate samples necessary to obtain accurate results within the sensor unit 14. A heating coil 40 is provided within the substrate 38. The heating coil 40 is heated by the heater line 28 under the control of the control unit 18.

Figure 3:
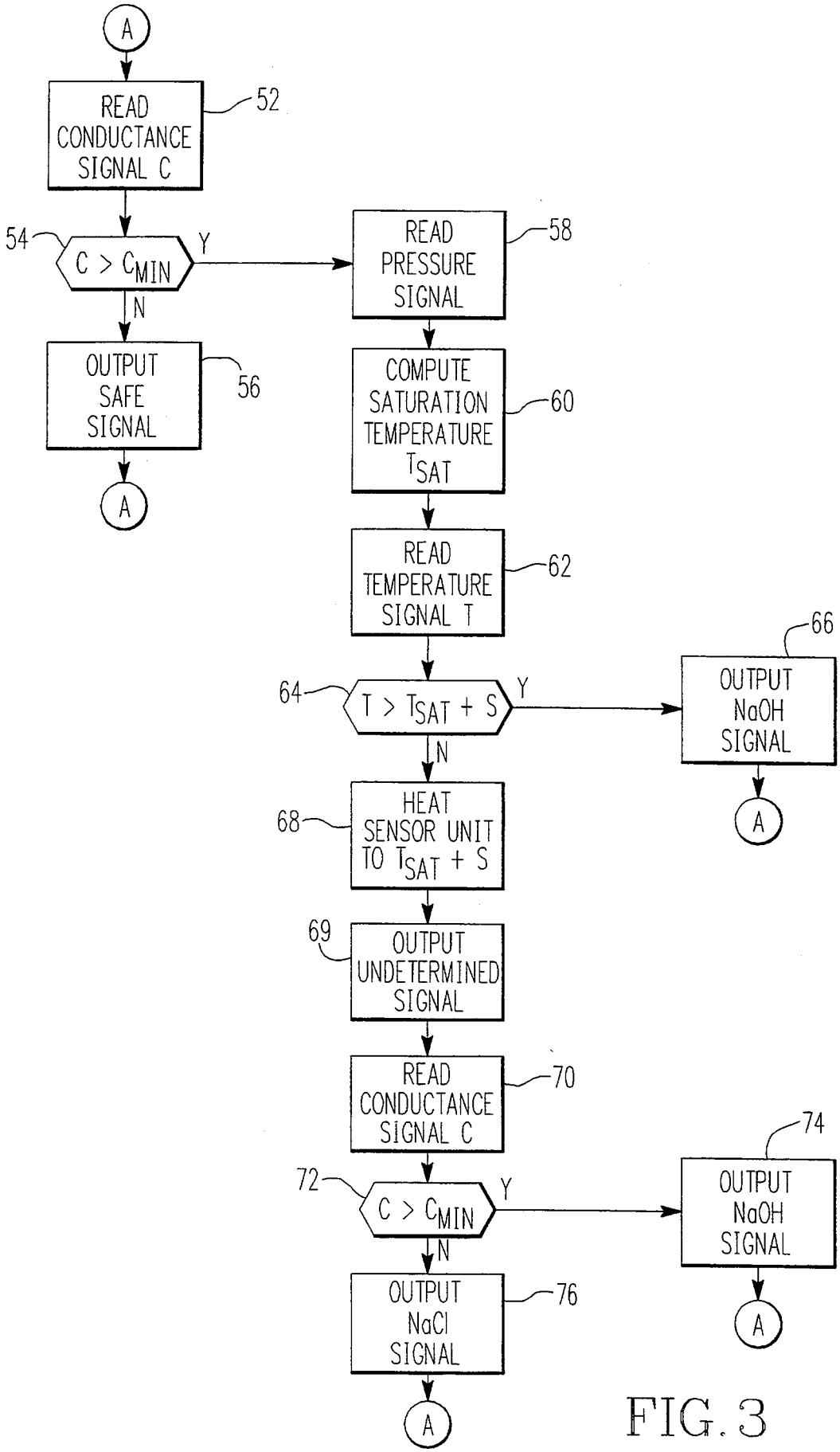
FIG. 3 is a flowchart of control performed by the control unit in the present invention.

The control unit 18 is preferably a microprocessor, such as an INTEL 80386, but the control may be easily implemented as any software, firmware or hardware device. The control unit may be programmed to perform the process illustrated in FIG. 3. Preferably, this process is performed periodically, e.g., every 10 seconds, so that sodium hydroxide and sodium chloride can be detected as soon as they occur in the steam turbine. The control unit 18 reads 52 a conductance signal from the conductance sensor 30. The conductance c is compared 54 to a predetermined minimum amount $C_{MIN}$. If the conductance c is not greater than the predetermined minimum amount $C_{MIN}$ then the conductance detected in the turbine is insufficient to indicate sodium hydroxide or sodium chloride, and a safe signal is output 56 to the display unit 29 indicating that neither sodium hydroxide nor sodium chloride is present.

If, however, in step 54, the conductance c exceeds the predetermined minimum amount $C_{MIN}$, the conductivity is sufficient to indicate sodium hydroxide or sodium chloride, and processing continues to determine whether these substances are present. The pressure is read 58 from the pressure sensor 34. The pressure is used to compute 60 a saturation temperature $T_{SAT}$ according to equation (1), $$T_{SAT} = \frac{5}{9} \frac{B}{A - \log P} - C - 32 + 273.15$$

where log P is the base 10 logarithm of the pressure in psia; A, B and C are constants with the values A=6.2530, B=3002.78 and C=378.4; and $T_{SAT}$ is in degrees Kelvin. Equation (1) is produced by rearrangement of the Antoine equation and conversion from degrees Fahrenheit to degrees Kelvin. The constants have been derived from the constants given in Lange's Handbook of Chemistry, 11th Ed., John A. Dean, ed., McGraw Hill, 1973. When the saturation temperature exceeds 300° F. (422° K.) or when a more accurate calculation is required, formulations available from the American Society of Mechanical Engineers (ASME) or the International Association for the Properties of Water and Steam (IAPWS) may be consulted.

In step 62, a temperature signal T is read from the temperature sensor 32, and the temperature signal T and saturation temperature $T_{SAT}$ are compared 64. If in step 64 the temperature T exceeds the saturation temperature $T_{SAT}$ by a predetermined superheat amount S, then the superheat and conductance levels are sufficient to indicate that sodium hydroxide is present, and a sodium hydroxide signal 66 is output to the display unit 29 to indicate that sodium hydroxide is present.

If, however, the control unit 18 determines 64 that the temperature does not exceed the saturation temperature by the predetermined amount S, then the control unit 18 outputs 68 a signal via the heater line 28 to heat the heating coil 40 in the sensor unit 14. During this time, the control unit 18 outputs 69 an undetermined signal to the display unit 29. When the heating coil 40 has increased the temperature to exceed the saturation temperature by significantly more than the amount S, the control unit reads 70 in the conductance c from the conductance sensor 36 and compares 72 the conductance c to the predetermined minimum amount $C_{MIN}$ to determine whether the heat has caused conductivity to fall to a nominal level. If the conductance c exceeds the amount $C_{MIN}$, the presence of sodium hydroxide is confirmed and the control unit 18 outputs 74 a sodium hydroxide signal to the display unit 29 to indicate the presence of sodium hydroxide. If, however, the conductance c does not exceed the minimum amount $C_{MIN}$, the existence of sodium chloride is confirmed and the control unit 18 outputs 76 a sodium chloride signal to the display unit 29 to indicate the presence of sodium chloride.

As a result of performing the above process, sodium hydroxide can be detected and distinguished from sodium chloride in a steam turbine. On this basis, a decision can be made whether to apply neutralizing acid to the turbine. Alternatively, this process can be performed to detect the presence of sodium hydroxide during the actual application of neutralizing acid to the steam turbine. Accordingly, the present invention would be able to detect when the sodium hydroxide has been neutralized by application of the neutralizing acid. Since the steam purity monitor according to the present invention checks for the presence of sodium hydroxide repetitively, the amount of neutralizing acid necessary to prevent the conversion can thereby be accurately determined. As a result, no more acid than necessary is added to the steam turbine.

Figure 4:
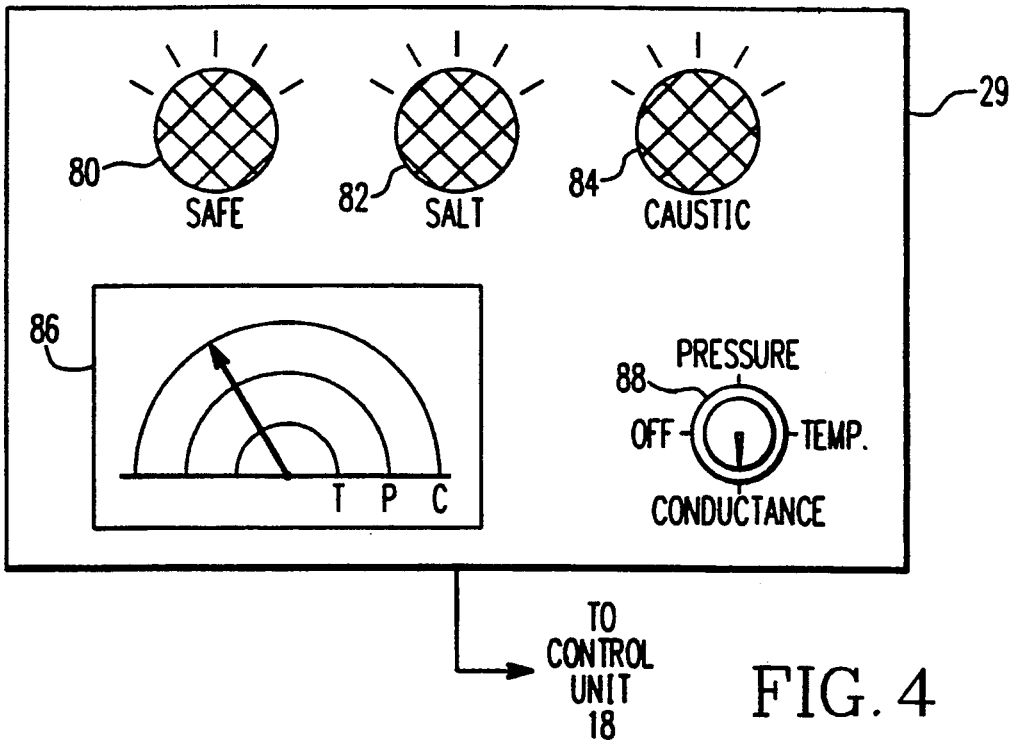
FIG. 4 shows a display of the steam purity monitor.

The display 29 is provided to indicate the existence or inexistence of sodium hydroxide or sodium chloride as determined by the control unit 18. The display 29 can be, for example, a conventional CRT or a simple light display. FIG. 4 illustrates a display unit 29 in the present invention. In FIG. 4, a green light 80 is provided to indicate a safe condition in the steam turbine in response to the safe signal output by the control unit 18 in step 56 of FIG. 3. A yellow light 82 is provided to indicate the presence of salt in the turbine in response the sodium chloride signal output by the control unit in step 76 of FIG. 3. A red light 84 is provided to indicate the presence of a caustic in the turbine in response to the sodium hydroxide signal output by the control unit in either step 66 or step 74 of FIG. 3. The red light provides an alarm indicating the presence of sodium hydroxide. The red light can be monitored to determine whether heating by the heating coil 40 has removed the possibility of sodium hydroxide. The red light can also be used to monitor whether addition of neutralizing acid has neutralized existing sodium hydroxide.

During heating of the sensor unit in step 68, both the yellow and red light can be displayed to indicate an undetermined condition in response to the undetermined signal output to the display unit 29 in step 69.

Ideally, the green light 80, the yellow light 82 and red light 84 are large enough to be seen from a reasonable distance. The display 29 also has a meter 86 capable of measuring either temperature, pressure or conductance, depending on a selection made with the knob 88. Thus the display 29 may be utilized to acquire further information about the circumstances under which a safe, salt or caustic condition is indicated by the lights 80, 82 and 84.

Figure 5:
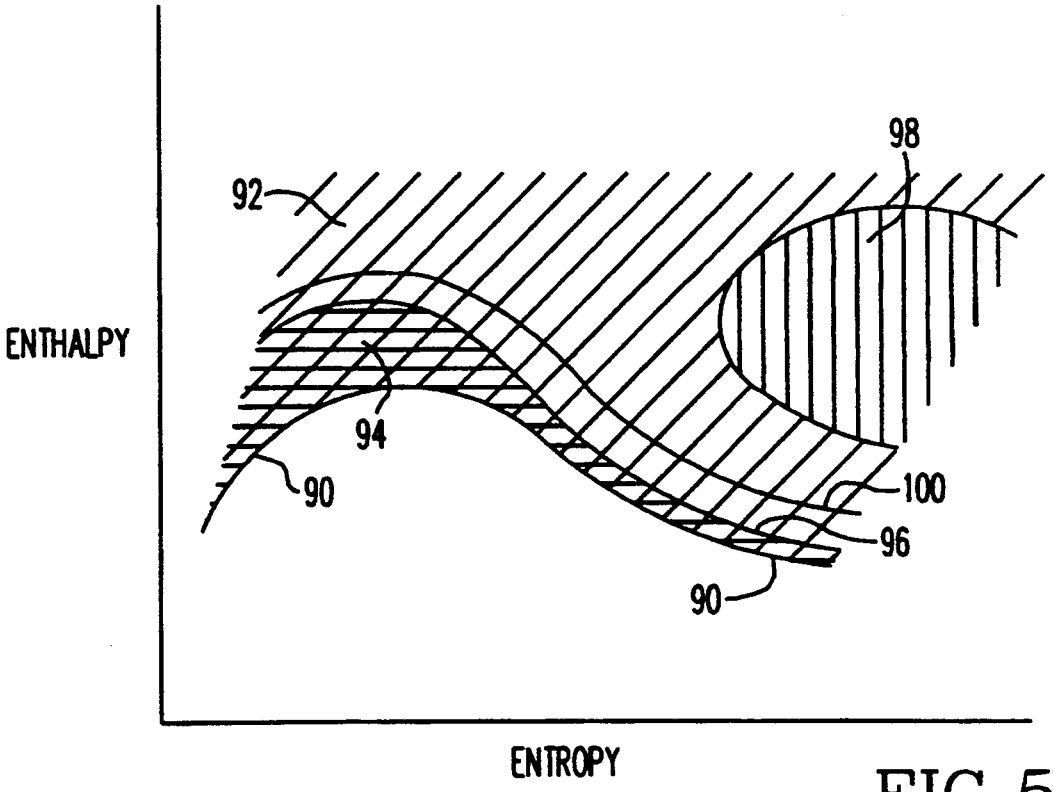
FIG. 5 is an entropy-enthalpy (Mollier) chart showing the temperature and pressure conditions under which sodium hydroxide and sodium chloride exist in liquid and solid form.

FIG. 5 is a Mollier chart showing the enthalpy and entropy of sodium hydroxide and sodium chloride in the turbine. The chart illustrates the conditions under which sodium hydroxide and sodium chloride form either as a liquid solution or as a solid. Above the pure water saturation line 90 sodium hydroxide exists in a liquid solution, as shown in the (diagonally hatched) liquid sodium hydroxide region 92. In the (horizontally hatched) liquid sodium chloride region 94 between the pure water saturation line 90 and the sodium chloride solid/liquid line 96, sodium chloride exists in a liquid solution. In the (vertically hatched) solid sodium hydroxide region 98, sodium hydroxide exists as a solid. Turbines do not conventionally operate within the solid sodium hydroxide region. The sodium chloride liquid solution region 94 lies within the sodium hydroxide liquid solution region 92. Either a sodium chloride or a sodium hydroxide solution can give rise to high conductivity in the sodium chloride liquid solution region 94. However, above the sodium chloride solid/liquid line 96, only sodium hydroxide exists in a liquid solution.

In the present invention, when conductance is detected to indicate one of the contaminants sodium hydroxide or sodium chloride, the specific cause can be differentiated if it is known whether conditions fall above or below the sodium chloride solid/liquid line 96. This differentiation can be accomplished by monitoring the turbine at a superheat level sufficient to ensure conditions above the sodium chloride solid/liquid line 96. The present invention accomplishes this by determining whether 50° F. superheat conditions exist within the turbine. As shown in FIG. 5, the 50° F. (28° C.) superheat line 100 is above the sodium chloride solid/liquid line 96 in the majority of the Mollier chart (representing all reasonable conditions that would occur in the turbine). Since the present invention monitors temperature and pressure, it can be determined whether the temperature exceeds the saturation temperature by 50° F. (28° C.), that is, whether 50° F. (28° C.) superheat exists. This is because at or above the 50° F. (28° C.) superheat line 100 only sodium hydroxide exists in a liquid solution. Sodium chloride above this line occurs as a solid. If the superheat level is below 50° F. (28° C.), the sensor unit 14 can be heated to create conditions ensuring that the two contaminants can be distinguished. Thus, when significant conductivity exists in the turbine under these conditions, the existence is sodium hydroxide is confirmed. If conductivity does not exist under these conditions, the existence of sodium chloride is confirmed. No turbines currently manufactured operate in the temperature and pressure region which includes the solid sodium hydroxide region.

In a second embodiment of the invention, instead of placing a single sensor unit 14 at a location where conditions are near 50° F. (28° C.) superheat, multiple sensor units can be placed within the turbine at locations having higher and lower superheat temperatures. For example, a first sensor unit can be placed at a 25° F. (14° C.) superheat location and a second sensor can be placed at a 100° F. (56° C.) superheat location. When conductivity is detected by the 25° F. (14° C.) superheat sensor unit, this unit would not have to be heated, since a 100° F. (56° C.) superheat sensor unit is already implemented.

Figure 6:
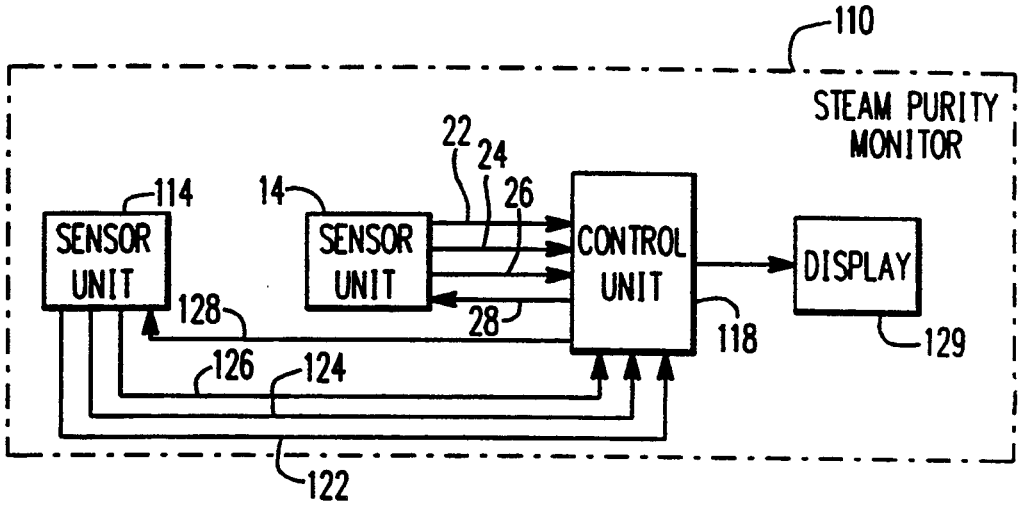
FIG. 6 is a block diagram of a second embodiment of the present invention.

FIG. 6 is an illustration of the second embodiment of the invention having multiple sensor units. In FIG. 6 the same figure elements are used to denote the same elements as in FIG. 1. The steam purity monitor 110 has an additional sensor unit 114 in addition to the sensor unit 14. A control unit 118 is provided which is capable of reading and averaging the information from sensor units 14 and 114. In addition to performing all of the functions of the control unit 18 shown in FIG. 1, the control unit 118 is connected to the additional sensor unit 114 by a conductivity line 122, a temperature line 124, a pressure line 126 and a heater line 128. These lines are identical to lines 22, 24, 26 and 28 which connect the sensor unit 14 to the control unit 118. The display 129 is connected to the control unit and may be a display like the display 29 illustrated in FIG. 4, but may have an additional meter for displaying the temperature pressure or conductivity of the additional sensor unit.

Figure 7:
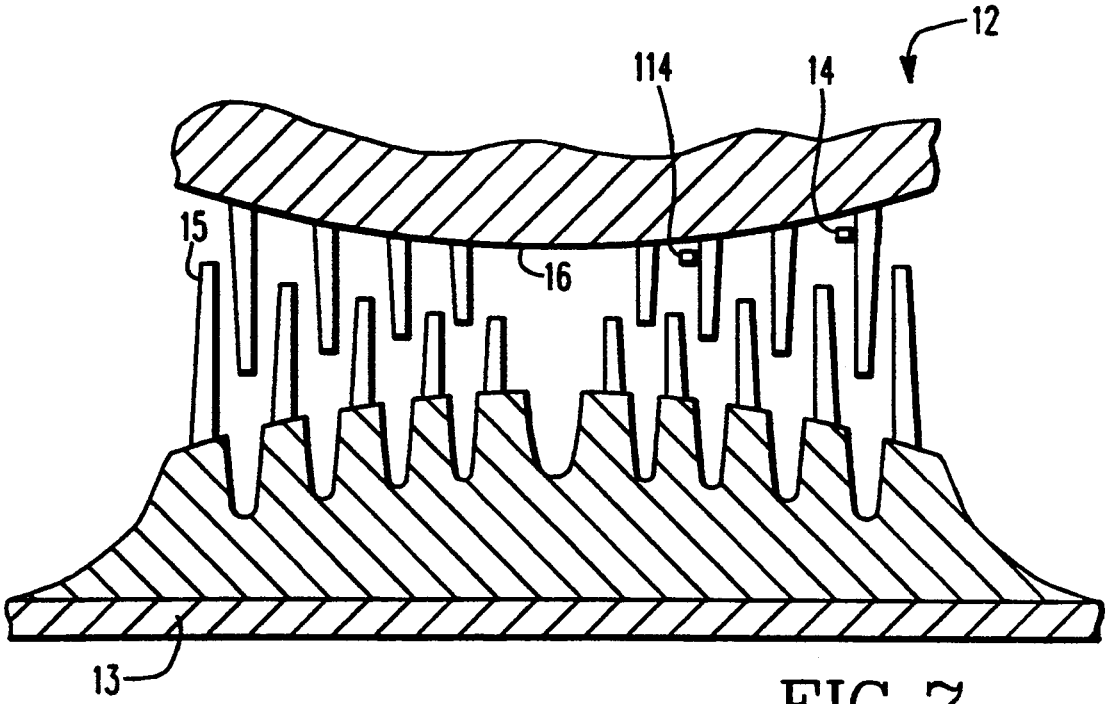
FIG. 7 shows the placement of the sensor units of the second embodiment in the steam turbine.

FIG. 7 shows the placement of the two sensor units 14 and 114 of the second embodiment within a longitudinal view of the steam turbine 12. The additional sensor unit 114, like the sensor unit 14, is mounted to the inner casing 16 of the steam turbine 12. The additional sensor unit 114 is mounted within the blades 15, further from the inner casing 16 than the sensor unit 14. Note that the blades 15, which appear as single lines in FIG. 1, can be seen as a series of blades in the different perspective of the longitudinal view in FIG. 7.

The many features and advantages of the invention are apparent from the detailed specification and thus it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of detecting contaminants in a steam turbine, comprising the steps of:

(a) measuring conductance, temperature and pressure in the steam turbine; and (b) indicating sodium hydroxide if the conductance exceeds a minimum conductance and the steam is at a superheat level as determined by the measured temperature and pressure.

2.A method according the claim 1, further comprising the step of:

(c) adding a neutralizing acid to the steam while repeating steps (a) and (b) until said indicating in step (b) no longer indicates sodium hydroxide.

3. A method according to claim 1, further comprising the step of:

(c) repeating steps (a) and (b) and indicating sodium chloride during the time that the conductance exceeds the minimum conductance at temperatures less than the superheat level and the conductance is less than the minimum conductance at temperatures greater than the superheat level in the steam turbine.

4. A method according to claim 3, further comprising the step of (d) displaying an indication of sodium hydroxide on a display during the time that said indicating in step (b) indicates sodium hydroxide, displaying an indication of sodium chloride on the display during the time that said indicating in step (c) indicates sodium chloride and displaying an indication of a safe condition during the time that said indicating in steps (b) and (c) does not indicate sodium hydroxide or sodium chloride.

5. A method according to claim 3, wherein said measuring in step (a) of the conductance, temperature and pressure in the steam turbine is performed by a sensor unit having a conductance sensor, temperature sensor and pressure sensor.

6. A method according to claim 5, wherein the sensor unit performing said measuring in step (a) is placed at a location in the turbine likely to be near the superheat level.

7. A method according to claim 5, further comprising the step of (d) heating the sensor unit performing said measuring in step (a) during the time that the temperature measured is below the superheat level at the pressure measured, and then repeating steps (a)–(c).

8. A method according to claim 7, further comprising the step of (e) initiating an alarm during the time that said indicating in step (b) indicates sodium hydroxide and continuing the alarm while repeating steps (a)–(e) until said indicating in step (b) no longer indicates sodium hydroxide after said heating in step (d).

9. A method according to claim 7, further comprising the step of (e) adding a neutralizing acid to the steam until said indicating in step (b) no longer indicates sodium hydroxide.

10. A steam purity monitor for detecting contaminants in a steam turbine, said steam purity monitor comprising:

sensor means for measuring conductance, temperature and pressure in the steam turbine; and control means for indicating sodium hydroxide during the time that the conductance exceeds a minimum conductance at a superheat level in the steam turbine.

11. A steam purity monitor according to claim 10, further comprising display means for displaying an indication of the sodium hydroxide, the sodium chloride and the safe condition as indicated by said control means.

12. A steam purity monitor according to claim 10, further comprising alarm means for initiating an alarm during the time that sodium hydroxide is indicated by said control means.

13. A steam purity monitor according to claim 12, further comprising heating means for heating the sensor unit during the time that the temperature and pressure are below the superheat level in the steam turbine.

14. A steam purity monitor according to claim 10, wherein said sensor means comprises a sensor unit having conductance, temperature and pressure sensors, each connected to said control means.

15. A steam purity monitor according to claim 14, wherein said heating means comprises a heating coil mounted with the sensor unit.

16. A steam purity monitor according to claim 10, wherein said sensor means comprises multiple sensor units each having conductance, temperature and pressure sensors each connected to said control means, each sensor unit being at a separate location where different temperature and pressure conditions are expected to exist.

17. A steam purity monitor according to claim 10, wherein said control means comprises a microcomputer, operatively connected to said sensor means, to read the conductance, the temperature and the pressure measured by said sensor means, to calculate a saturation temperature based on the pressure, to compare the saturation temperature to the temperature and to indicate sodium hydroxide during the time that the temperature exceeds the saturation temperature by the superheat level while conductance exceeds a minimum conductance.

18. A steam purity monitor according to claim 10, wherein said control means comprises a programmable logic controller, operatively connected to said sensor means, to read the conductance, the temperature and the pressure measured by said sensor means, to calculate a saturation temperature based on the pressure, to compare the saturation temperature to the temperature and to indicate sodium hydroxide during the time that the temperature exceeds the saturation temperature by the superheat level while conductance exceeds a minimum conductance.

19. A steam purity monitor for detecting contaminants in a steam turbine, comprising:

a sensor unit comprising a conductance sensor to detect conductivity in the steam turbine, a temperature sensor to detect temperature in the steam turbine, and a pressure sensor to detect pressure in the steam turbine;

a control unit, operatively connected to said sensor unit, to determine a presence of sodium hydroxide or sodium chloride based on the conductance, temperature and pressure detected by the sensor unit at a superheat level; and a display, operatively connected to said control unit, to display an indication of sodium hydroxide or sodium chloride in the steam purity monitor.

20. A method of detecting contaminants in a steam turbine, comprising the steps of:

(a) reading a first conductance signal from a conductivity sensor;

(b) comparing the first conductance signal to a first minimum conductance level; and (c) determining whether the first conductance signal is greater than the first minimum level and, during the time that the first conductance signal is not greater than the first minimum conductance level, outputting a safe signal to a display unit, or, during the time that the first conductance signal is greater than the first minimum conductance level, performing the steps of:

reading a pressure signal and computing therefrom a saturation temperature;

reading a temperature signal;

comparing the temperature signal to the saturation temperature and, during the time that the temperature signal is greater than the saturation temperature and indicative of a superheat level, outputting a sodium hydroxide signal, or, during the time that the temperature signal is not greater than the saturation temperature, performing the steps of:

heating the sensor unit;

reading a second conductance signal;

comparing the second conductance signal to a second minimum conductance level and, during the time that the second conductance signal is greater than the second minimum conductance level, outputting a sodium hydroxide signal, or, during the time that the second conductance signal is not greater than the second minimum conductance level, outputting a sodium chloride signal.

* * * * *